US005184428A

United States Patent [19]

Feldt et al.

[11] Patent Number: 5,184,428

[45] Date of Patent: Feb. 9, 1993

[54] DEVICE FOR ADJUSTING A CNC-CONTROLLED GRINDER

[75] Inventors: Wolfgang Feldt, Grundau; Dieter Laese, Wiesbaden, both of Fed. Rep. of Germany

[73] Assignee: MAN Roland Druckmaschinen AG, Fed. Rep. of Germany

[21] Appl. No.: 858,011

[22] Filed: Mar. 26, 1992

[30] Foreign Application Priority Data

Mar. 28, 1991 [DE] Fed. Rep. of Germany ..... 4110209

[51] Int. Cl.[5] ..... B24B 49/12

[52] U.S. Cl. ..... 51/165.75; 51/165.72; 250/229

[58] Field of Search ..... 51/165.72, 165.74, 165.75, 51/165.76; 250/222.1, 229, 231.1, 221

[56] References Cited

U.S. PATENT DOCUMENTS 4,679,358 7/1987 Sieradzki ..... 51/165.72

FOREIGN PATENT DOCUMENTS 3221381 10/1987 Fed. Rep. of Germany .

3743275 7/1989 Fed. Rep. of Germany .

*Primary Examiner*—M. Rachuba
*Assistant Examiner*—Eileen P. Morgan
*Attorney, Agent, or Firm*—Leydig, Voit & Mayer

[57] ABSTRACT

A device for establishing the initial distance between the surface of a grinding tool and the surface of a workpiece to be ground. A combination of an active and a passive sensing element rigidly connected at a known distance is positioned between the workpiece and the grinding tool. The workpiece is brought into contact with the passive sensing element and both the workpiece and sensing elements are moved toward the grinding tool while maintaining contact. The active sensing element senses the grinding tool when the distance between the tool and the workpiece is equal to the distance between the active and passive sensing elements. When this occurs, the active sensing element provides a signal and therefore the distance at which the grinding wheel will meet the workpiece can be calculated. A fixed abutment is also provided so that absolute measurements of the dimensions of the workpiece or grinding tool can be obtained.

8 Claims, 2 Drawing Sheets

DEVICE FOR ADJUSTING A CNC-CONTROLLED GRINDER

FIELD OF THE INVENTION

This invention relates generally to computer controlled grinding machines and more particularly concerns a device for establishing the initial relative positions of the grinding wheel and the workpiece to be machined.

BACKGROUND OF THE INVENTION

In computer numerically controlled grinders (CNC-controlled grinders) the position of a workpiece relative to the position of the grinding tool must be precisely determined so that a programmed grinding procedure will be properly performed on the workpiece. This measurement must be frequently updated because the tool dimensions are continuously altered, thereby changing the zero, or contact, position.

Various conventional procedures exist to solve this problem. In one procedure, for example, the workpiece itself is brought into contact with the grindstone. Sonic or vibration measuring means detect this contact and thus the relative positions of both the workpiece and grindstone are determined and stored simultaneously. However, in this procedure processing of the measured data is relatively expensive. Another drawback is that this procedure cannot detect absolute dimensions of the workpiece or tool. Furthermore, because contact is made between the workpiece and tool, the piece can be indented or scratched by the grindstone. Finally, access to the desired contact point on the workpiece may be impossible due to the radius of the grindstone.

Another method for solving this problem uses a measuring sensor to examine the surface of the workpiece. The workpiece and the sensor are moved toward one another. The measured value is then stored in the CNC-control. Following this measurement, the grindstone diameter is measured, for example with an optical sensing facility. Then the grindstone and the sensor are moved toward one another. In this approach, two separate measurement steps must be taken and two measuring facilities are needed.

A third method is to optically determine the outer contours of the workpiece and the grindstone. For example, laser scanners may sense and transmit this contour data to a computer. The computer then analyzes the data and generates a control program based on the geometries of the workpiece and grinding tool. Such a system detects and compensates for all of the deviations in the workpiece and grindstone, and also performs the measurements while machining takes place. This type of system, however, requires elaborate hardware and software and is therefore extremely expensive.

SUMMARY OF THE INVENTION

It is, therefore, an object of the invention to provide a simple and cost effective device for rapid detection of the position of the workpiece surface relative to the grindstone contour, where the positions of the workpiece and grindstone are detected simultaneously, and where such a device does not scratch or indent the tool or workpiece surfaces and operates substantially without collision.

Briefly, the present invention provides a device for rapidly establishing the distance between the outer edge of a grinding wheel and a selected point on a workpiece.

A sensing device, consisting of a passive contact sensor on one end, and a light source and sensor on the other, is positioned between the wheel and workpiece. Next, the passive contact sensor is brought into contact with the workpiece at a desired point. The piece is then moved toward the grinding wheel, and because the sensing device is free to move with the workpiece, both the device and the workpiece approach the wheel while maintaining contact with one another. Alternatively, the wheel may move toward the sensing device and workpiece.

Regardless of which of the parts move, the light source and sensor combination is configured so as to detect the grinding wheel when it interrupts the beam of light from the source to the sensor. Thus, when the grinding wheel is at exactly the right distance from the workpiece, the beam is interrupted, and the relative movement is halted. Because the distance from the contact sensor to the light source and sensor combination is known, the distance from the workpiece to the outer edge of the grinding wheel is known, and can be stored. The sensing device is then removed and machining can begin.

The sensing device combines the sensing elements for the workpiece and for the grindstone in a single unit, so that a very compact, inexpensive tool is provided. Since positioning is built into the sensing unit, operators need not make independent positioning measurements that would have to be highly accurate and extremely stable. Additionally the sensor does not require its own feed axis because it can move with the workpiece using a simple sensing pin. No collision occurs between the grindstone and the workpiece so no sensing indents or scratches are produced. Furthermore, only a single signal needs to be processed, and it comes from the existing feed axis of the grinding tool or grindstone.

Other objects and advantages of the present invention will become apparent upon consideration of the following detailed description when taken in conjunction with the drawings.

While the invention will be described in connection with certain preferred embodiments, it will be understood that it is not intended to limit the invention to these particular embodiments. On the contrary, it is intended to cover all alternatives, modifications and equivalent arrangements as may be included within the spirit and scope of the invention.

DETAILED DESCRIPTION OF THE PREFERRED EMBODIMENT

Figure 1:
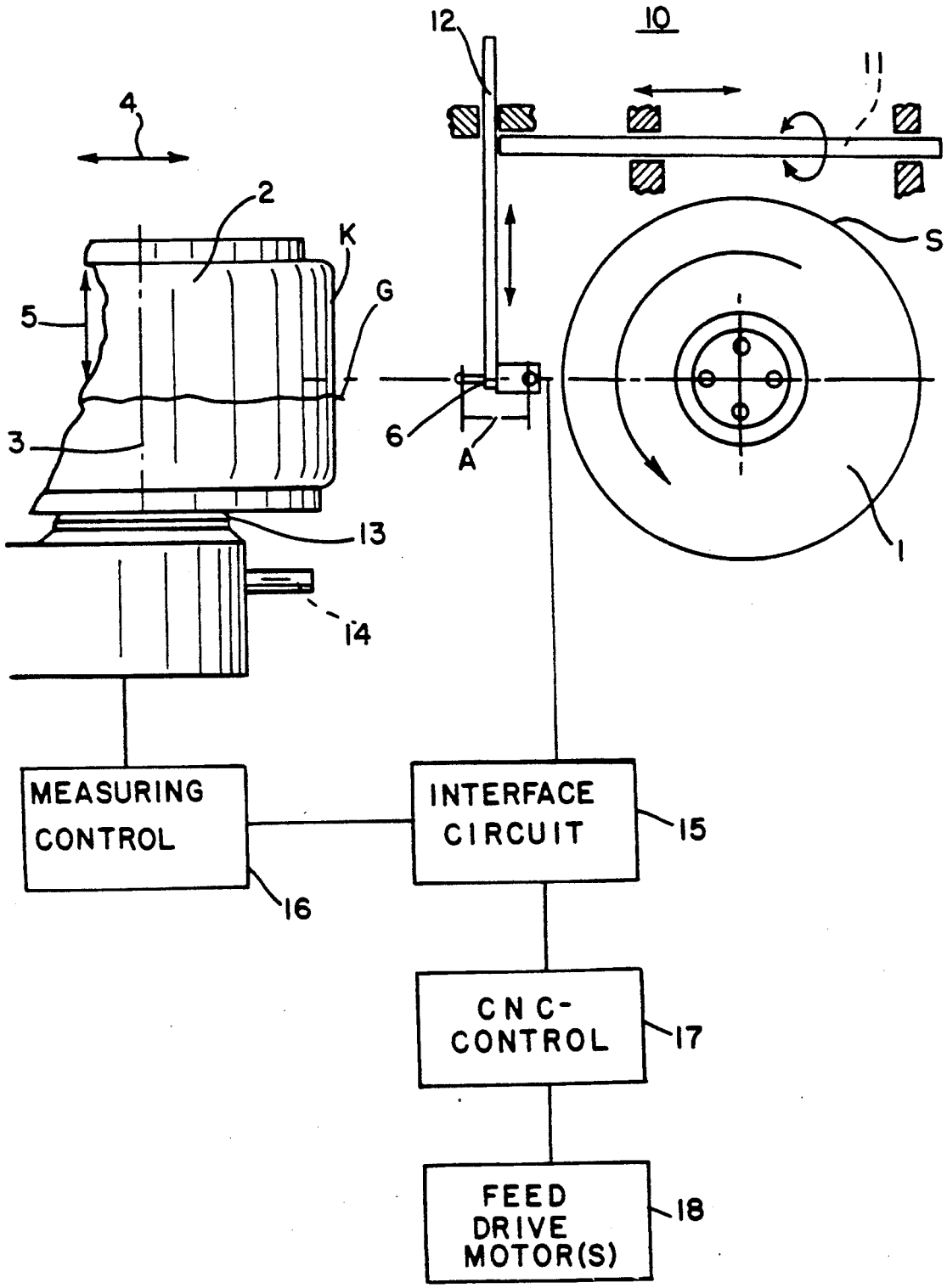
FIG. 1 is a view showing a workpiece and a grindstone, with a sensing device located between the grindstone and the workpiece according to the invention.

FIG. 1 shows an arrangement between a grindstone 1 and a workpiece 2. By way of example, the workpiece is shown with an edge, such as a burr G, which is to be removed as far as the outer contour K of the workpiece. Therefore, the position of the contour K must be determined relative to the outer diameter S of the grindstone.

The desired contour K is programmed in a CNC-control 17 (the CNC-control being of a conventional design), so that movement will take place along at least one of several possible movement axes. In FIG. 1, the feed movements have been allocated to the workpiece 2. One possible way in which the workpiece 2 could move is depicted as rotational axis 3. A linear feed axis 4 shows the movement of the workpiece 2 relative to the grindstone 1. Another possibility of linear movement is depicted by vertical feed axis 5, which is parallel to rotational axis 3.

To define the zero position, i.e., the position where the outer edge S of the grindstone 1 will contact the outer contour K of the workpiece 2 in accordance with the grinding program in the CNC-control 17, a sensing device 6 is moved into the zone between the workpiece 2 and the grindstone 1.

Figure 2:
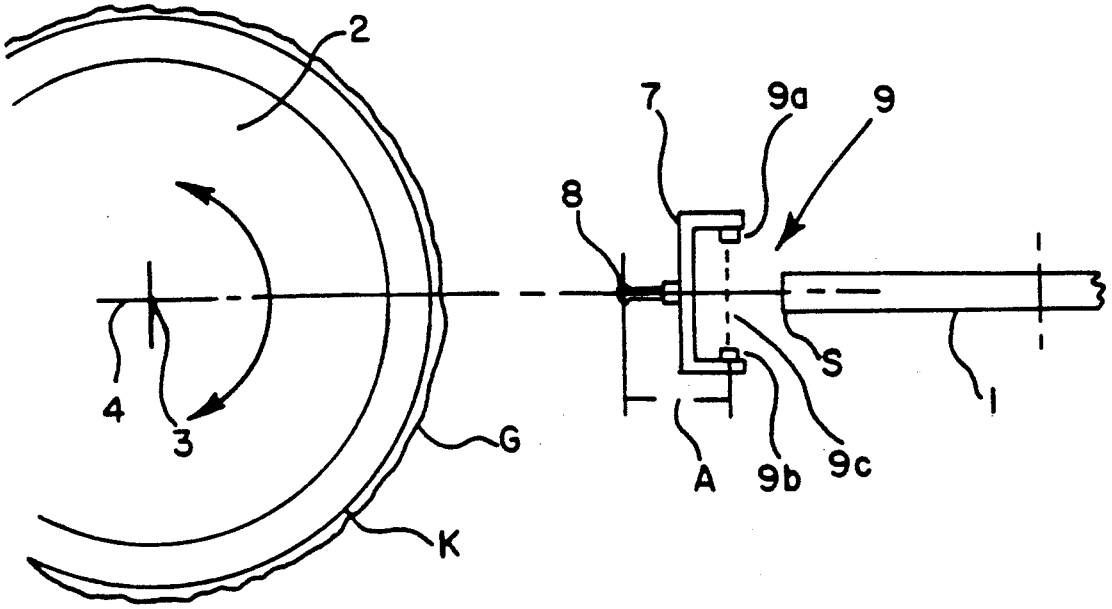
FIG. 2 is a plan view showing a sensing device located between the grindstone and the workpiece according to the invention.

Referring to FIG. 2, the sensing device 6 consists of a frame 7 to which a sensing pin 8 and an optoelectronic sensor 9 are rigidly connected. The optoelectronic sensor 9 shown consists of a light source (or transmitter) 9*a* and light sensor (or receiver) 9*b*, the source transmitting a beam of light 9*c* to the sensor. The part of the frame 7 supporting the light source and sensor is fork-shaped so as to fit around the contour of the grindstone 1. The light source 9*a* is located in one of the arms of the fork, and the light sensor 9*b* is located in the other arm of the fork.

Returning to FIG. 1, the optoelectronic sensor 9 is connected to an interface circuit 15 which monitors the signal produced by the light sensor 9*b* to detect when the light beam 9*c* is interrupted. Upon interruption of the light beam 9*c*, the interface circuit 15 communicates this occurrence to the CNC-control 17. The interface circuit 15 is also connected to a measuring control 16 (the measuring control 16 being of a conventional design) of the feed axis which produces the spacing movement between the grindstone 1 and the workpiece 2.

Upon receiving the signal from the light sensor 9*b*, the interface circuit 15 stores the signals from the measurement control 16 that represent the relative position of the grindstone 1 and workpiece 2. This can be accomplished by including circuitry in interface circuit 15 to latch the measurement signals from the measurement control 16 when the monitoring circuit detects the interruption signal from light sensor 9*b*. The interface circuit then communicates the measurement signals to the CNC-control 17. Alternatively, the CNC-control 17 can be configured to store the measurement signals directly when notified of the interruption of the light beam. In either case, the CNC-control 17 then operates the drive motor or motors 18 that move either the workpiece 2 or the grindstone 1 in accordance with a program executed by the CNC-control. Shown here, the feed drive motor or motors 18 may move the workpiece along linear axes 4 and 5 and/or rotate the workpiece about rotational axis 3.

The frame 7 (FIG. 2) of the sensing device 6 (FIG. 1) is secured to movable mounting 10, which comprises a pivoting arm 11 and a support arm 12. The arm 11 is displaceable in the direction of its longitudinal axis, and can also be rotated on its pivoting axis. The pivoting axis is the same as the longitudinal axis of the pivoting arm, which are parallel to workpiece feed axis 4. The support arm 12 is secured to the end of the pivoting arm 11 perpendicular to the pivoting arm's longitudinal axis. The support arm 12 is also adjustable lengthwise. The sensing device 6 is secured at the bottom end of the support arm 12. The sensing device 6 is oriented so that the contact pin 8 (FIG. 2) is in the direction of the feed axis 4 (FIG. 1) and points toward the workpiece when the sensing device 6 is between the grinding wheel and workpiece. The mounting 10 can be moved automatically so that the sensing device is properly positioned between the grinding wheel and workpiece.

The invention operates by rotating pivoting arm 11 on its pivoting axis, thereby pivoting the sensing device 6 from a standby position that is not between the grindstone 1 and workpiece 2 into an operating position within the zone between the grindstone 1 and the workpiece 2. The sensing device 6 can also be lowered as needed by means of supporting arm 12 into the operating position, as shown in FIGS. 1 and 2.

After the sensing device 6 is in the operating position as shown in FIGS. 1 and 2, the pivoting arm 11 is then disengaged from its drive so as to be freely displaceable in the direction of feed axis 4. The workpiece 2 can be adjusted in the direction of feed axis 5 to further adjust the contact pin 8 to the height of the contour K to be sensed, i.e., to a point adjacent the burr G. The workpiece 2 is then moved in the direction of the feed axis 4 towards the sensing device until the pin contacts the workpiece. When the feed drive motor 18 moves the workpiece in the direction of feed axis 4 toward the grindstone 1, the sensing device 6 is also moved with the workpiece since the pivot arm 11 is free to move lengthwise. When the outer contour S of the grindstone is reached, the beam of light 9*c* from the light source 9*a* to the light sensor 9*b* in optoelectronic sensor 9 is interrupted. Interface circuit 15, which monitors the optoelectronic sensor, signals the CNC-control and the feed drive motor 18 is halted. At this time the measuring control 16 provides a measured value which is stored in the CNC-control 17.

As a result of obtaining the measured value, a measurement of the position of the grindstone contour S relative to outer contour K of the workpiece is known. Since an accurately defined fixed distance A is present between contact pin 8 and the light beam 9*c* of optoelectronic sensor 9, the contact, or zero position of the contour K and the grindstone contour S can be calculated by the CNC-control 17.

Alternatively, should an absolute measurement of the workpiece and/or tool dimensions be desired, a fixed abutment 14 connected to a workpiece mounting 13 is provided. The fixed abutment 14 extends parallel to feed axis 4 at a precise distance known to CNC-control 17. The distance from the fixed abutment 14 to the center of the grindstone 1 is also known precisely. The contact pin of the sensing device 6 is then brought into contact with the fixed abutment 14. The sensing device 6 is then moved toward the grindstone in the same manner as previously described, until the outer contour S of the grindstone 1 is reached. The radius of the grindstone 1 can then be calculated by the CNC-control 17 using the known distance from the fixed abutment 14 to the center of the grindstone 1, the known distance A from the contact pin 8 to the optoelectronic sensor 9, and the distance traversed by the sensing device 6. Once the radius of the grindstone 1 is known, the absolute dimensions of the workpiece 2 can be ascertained using the known distance A from the optoelectronic sensor 9 to various contact points on the workpiece, using the same procedure used to establish the relative distance from contour K to grindstone contour S.

In summary, this simple and low-cost construction facilitates zero adjustment for a grinding procedure as well as absolute measurements of a grindstone diameter and workpiece dimensions.

We claim as our invention:

1. A device for establishing the relative position of a tool and a workpiece, the device comprising:

a sensing device positioned between the workpiece and tool and having a passive contact sensing element rigidly secured to an active sensing element at a known distance such that the passive contact sensing element mechanically contacts the workpiece;

means for providing relative movement of the workpiece and the sensing device toward the tool and along a main feed axis until the active sensing element detects the position of the tool; and control means responsive to the active sensing element for determining the relative distance between the tool and the workpiece based on the known distance between the active and passive contact sensing elements.

2. A device according to claim 1 wherein the sensing device is rigidly attached to a mounting in order to facilitate positioning of said sensing device between the tool and the workpiece, said mounting and attached sensing device being freely displaceable in the direction of the main feed axis.

3. A device according to claim 1 wherein the passive contact sensing element is a sensing pin, and the active sensing element comprises a light source and a light sensor, the light source and light sensor configured so that the light source provides light to the light sensor such that the tool interrupts the light sensed by the sensor, and thereby signals the control means without contact occurring between the active sensing element and the tool.

4. A device according to claim 1, including monitoring means for monitoring the active sensing element and providing an interface circuit between the active sensing element and the control means.

5. A device according to claim 4 wherein the monitoring means include memory for storing data representative of the relative positions of the tool and workpiece, and communicate the stored data to the control means.

6. A device according to claim 1 wherein the control means include memory for storing data representative of the relative positions of the tool and workpiece and to operate the movement means in accordance with the stored data.

7. A device according to claim 2 wherein the mounting comprises a pivoting arm attached perpendicularly to a supporting arm, said supporting arm further attached to the sensing device, so that the sensing device and supporting arm are pivotable around the longitudinal axis of the pivoting arm.

8. A device according to claim 1 wherein a fixed abutment associated with the movement of said workpiece makes mechanical contact with the passive contact sensing element, so that absolute measurements of the workpiece and tool dimensions can be determined.

* * * * *